US005846013A

United States Patent [19]

To

[11] Patent Number: 5,846,013

[45] Date of Patent: Dec. 8, 1998

[54] RING BINDER

[75] Inventor: Chun Yuen To, Hong Kong, Hong Kong

[73] Assignee: World Wide Stationery Manufacturing Company Limited, Hong Kong, Hong Kong

[21] Appl. No.: 604,612

[22] Filed: Feb. 21, 1996

[51] Int. Cl.[6] ..... B42F 3/04

[52] U.S. Cl. ..... 402/36; 402/38

[58] Field of Search ..... 402/26, 36, 38, 402/39, 40, 41, 42

[56] References Cited

U.S. PATENT DOCUMENTS

| | | | |
|---|---|---|---|
| 4,368,995 | 1/1983 | Cohen . | |
| 4,434,534 | 3/1984 | Handler . | |
| 5,180,247 | 1/1993 | Yu | 402/38 X |
| 5,286,128 | 2/1994 | Gillum | 402/36 X |
| 5,348,412 | 9/1994 | Fullen | 402/38 |

FOREIGN PATENT DOCUMENTS

| | | |
|---|---|---|
| 707981 A1 | 10/1994 | European Pat. Off. . |
| 1484908 | 12/1973 | United Kingdom . |
| 2004816 | 9/1978 | United Kingdom . |
| 2209500 | 9/1988 | United Kingdom . |

*Primary Examiner*—Willmon Fridie, Jr.
*Attorney, Agent, or Firm*—Pollock, Vande Sande & Priddy

[57] ABSTRACT

A ring binder is disclosed as comprising a substantially rigid curved upper plate supporting a pair of pivotable lower plates mounted with a plurality of pairs of half rings, and a lever at each end of the ring binder, wherein the curved upper plate comprises a W-shaped ridge member or trough member between each of its longitudinal ends and the pair of half rings nearest thereto.

14 Claims, 2 Drawing Sheets

RING BINDER

FIELD OF THE INVENTION

This invention relates to a ring binder and, in particular, a ring binder adapted to be secured to a base member, e.g. a cardboard, plastic or metal cover.

BACKGROUND OF THE INVENTION

In order to lower the cost of manufacture, ring binders, in particular the curved upper plate thereof, have been made of thinner and thinner materials. However, the two longitudinal ends of the curved upper plate are required to be of sufficient rigidity and strength for the following reasons:

(1) the curved upper plate has to withstand the force transmitted by the lower pivotable plates exerted by the opening/closing levers during the pivoting movements of the levers; and (2) the ring binder is securable by rivets to the cover, usually via holes at either end of the curved upper plate.

It is the object of the present invention to provide a ring binder which is made of thin materials, while still providing the necessary strength and rigidity.

SUMMARY OF THE INVENTION

According to the present invention, there is provided a ring binder comprising a substantially rigid upper structure supporting a pivotable lower structure mounted with a plurality of pairs of ring members, and an opening mechanism at one or each end thereof, wherein the upper structure comprises a ridge member or trough member between one or each of its longitudinal ends and the pair of ring members nearest thereto.

Advantageously, the upper structure may comprise a ridge member between a first longitudinal end and the pair of ring members nearest thereto, and a trough member between a second longitudinal end and the pair of ring members nearest thereto.

Suitably, the upper structure may comprise a first ridge member between a first longitudinal end and the pair of ring members nearest thereto, and a second ridge member between a second longitudinal end and the pair of ring members nearest thereto.

Preferably, the upper structure may comprise a first trough member between a first longitudinal end and the pair of ring members nearest thereto, and a second trough member between a second longitudinal end and the pair of ring members nearest thereto.

The upper structure may advantageously further comprise at least one aperture for engagement with a securing means adapted to secure the ring binder to a base member, and wherein the ridge member or trough member extends between one or each longitudinal end of the upper structure and the aperture nearest thereto. As shown in FIG. 3, the ridge or trough member terminates between each longitudinal end of the upper structure and the aperture nearest thereto.

The ridge member or trough member may suitably comprise two ends pointing generally towards the longitudinal end nearest thereto.

The ridge member or trough member may preferably comprise a middle peak portion lying substantially on the longitudinal axis of the upper structure.

Advantageously, the ridge member or trough member may be substantially symmetrical about the longitudinal axis of the upper structure.

Suitably, the ridge member or trough member may be substantially W-shaped.

BRIEF DESCRIPTION OF THE DRAWINGS

The present invention will now be described, by way of example only, with reference to the accompanying drawings, wherein.

DESCRIPTION OF PREFERRED EMBODIMENTS

Figures 1, 2:
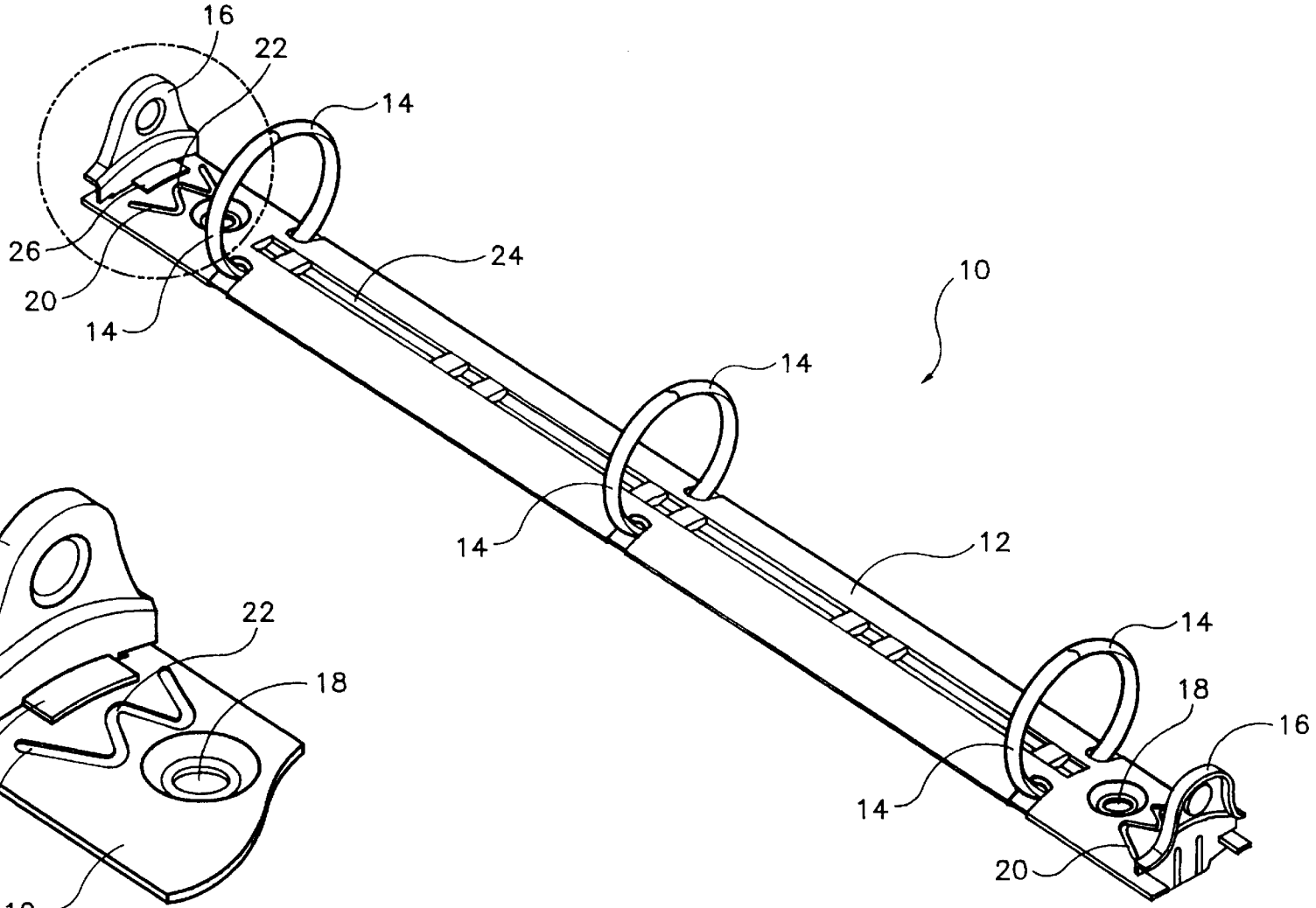
FIG. 1 shows a perspective view of a ring binder according to the present invention.
FIG. 2 shows an enlarged view of the part circled in FIG. 1.
Figure 3:
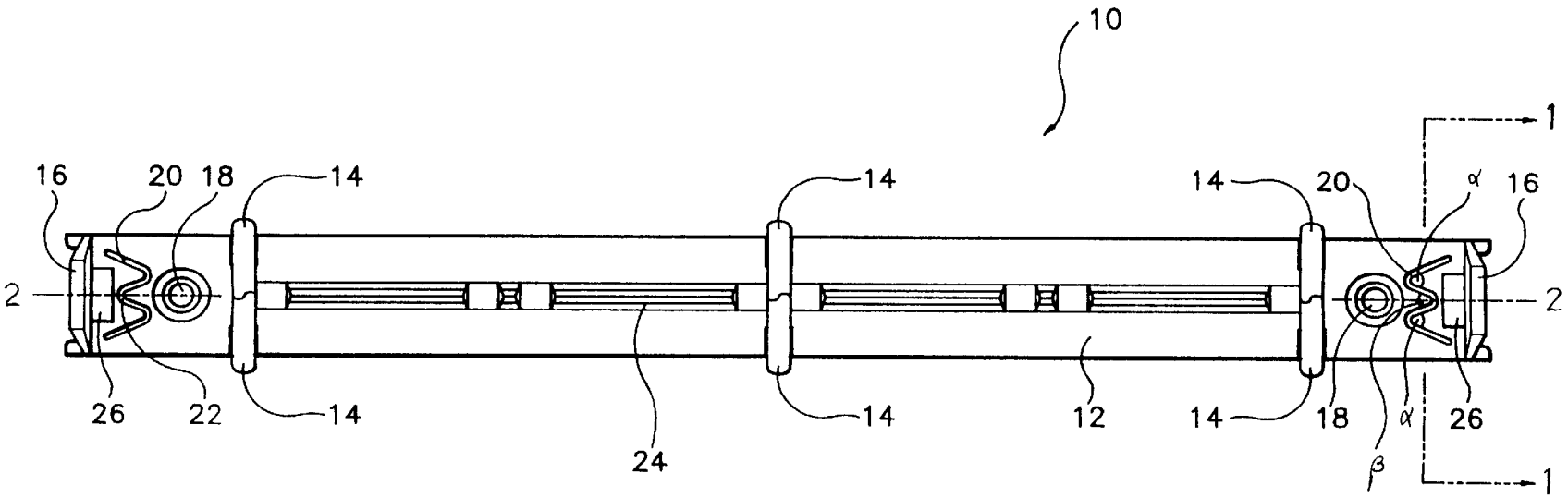
FIG. 3 shows a top view of the ring binder shown in FIG. 1.

Referring to FIGS. 1 and 3, a ring binder generally designated as 10 comprises a substantially rigid curved upper plate 12 which is bent inward at both lateral sides to support a pair of pivotable lower plates (not shown). Mounted on the pivotable plates are three pairs of half rings 14. Outward pivoting of a pair of actuating levers 16 causes the pair of lower plates to pivot and thereby to open the three pairs of half rings 14. On the curved upper plate 12 are two holes 18 through each of which a rivet (not shown) may be received and thereby to secure the ring binder 10 to a cover (not shown).

Figure 4:
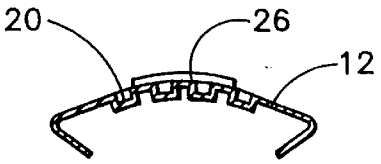
FIG. 4 shows a sectional view of the ring binder shown in FIG. 3 along the line 1—1, with the opening/closing levers and lower plates removed for clarity purposes.

As can be seen more clearly in FIGS. 2 and 4, a W-shaped channel 20 lies on the upper plate 12 between each lever 16 and the hole 18 nearest thereto. The channel 20 significantly increases the rigidity and strength of upper plate 12 in the aforesaid areas, while allowing the upper plate 12 to be made of a relatively thin material. To impart equal strength and rigidity to both sides of the upper plate 12, the channel 20 is disposed symmetrical about the longitudinal axis (indicated by the line 2—2 in FIG. 3) of the upper plate 12 with the middle peak 22 of the channel 20 lying on the longitudinal axis. The angle of the two outer turning points, i.e. $\alpha$ in FIG. 3, of the W-shaped channel 20 is equal to that of the middle turning point, i.e. $\beta$ in FIG. 3, and is preferably within the range of 50° to 70°. In the embodiment shown in the drawings, the angles are substantially 60°.

To further enhance the rigidity and strength of the upper plate 12, there is provided a groove 24 running along the longitudinal axis of the upper plate 12 between the two pairs of outermost half rings 14. At each end of the upper plate 12 adjacent the actuating lever 16 is provided with an upwardly extending ramp 26. This also assists in increasing the strength and rigidity of the upper plate 12. It can be seen from the drawings that the ends of the W-shaped channel 20 extend to both sides of the ramps 26.

In the describe embodiment, the upper plate 12 comprises downwardly protruding channels 20. It is possible to achieve substantially the same result by providing instead upwardly protruding ridges.

It should be understood that the above only illustrates ways in which the present invention may be carried out and it is possible that modifications and/or alterations may be made thereto without departing from the spirit of the invention.

I claim:

1. A ring binder comprising:

a substantially rigid upper structure having a first and a second longitudinal end;

a pivotable lower structure supported by said upper structure;

a plurality of pairs of half ring members mounted on said pivotable lower structure;

an opening mechanism at one or each longitudinal end of said upper structure;

a plurality of securing means for securing the ring binder to an article; and a ridge or trough member on said upper structure lying and terminating between one or each of said longitudinal ends of the upper structure and a securing means nearest thereto;

wherein the upper structure comprises a ridge member between said first longitudinal end and the securing means nearest thereto, and a trough member between said second longitudinal end and the securing means nearest thereto.

2. A ring binder comprising:

a substantially rigid upper structure having a first and a second longitudinal end;

a pivotable lower structure supported by said upper structure;

a plurality of pairs of half ring members mounted on said pivotable lower structure;

an opening mechanism at one or each longitudinal end of said upper structure;

a plurality of securing means for securing the ring binder to an article; and a ridge or trough member on said upper structure lying and terminating between one or each of said longitudinal ends of the upper structure and a securing means nearest thereto;

wherein the upper structure comprises a first trough member between said first longitudinal end and the securing means nearest thereto, and a second trough member between said second longitudinal end and the securing means nearest thereto.

3. A ring binder comprising:

a substantially rigid upper structure having a first and a second longitudinal end;

a pivotable lower structure supported by said upper structure;

a plurality of pairs of half ring members mounted on said pivotable lower structure;

an opening mechanism at one or each longitudinal end of said upper structure;

a plurality of securing means for securing the ring binder to an article; and a ridge or trough member on said upper structure lying and terminating between one or each of said longitudinal ends of the upper structure and a securing means nearest thereto;

wherein the ridge member or trough member comprises a middle peak portion lying substantially on the longitudinal axis of the upper structure.

4. A ring binder comprising:

a substantially rigid upper structure having a first and a second longitudinal end;

a pivotable lower structure supported by said upper structure;

a plurality of pairs of half ring members mounted on said pivotable lower structure;

an opening mechanism at one or each longitudinal end of said upper structure;

a plurality of securing means for securing the ring binder to an article; and a ridge or trough member on said upper structure lying and terminating between one or each of said longitudinal ends of the upper structure and a securing means nearest thereto;

wherein the ridge member or trough member is substantially W-shaped.

5. A ring binder comprising substantially rigid upper structure having a longitudinal axis defined by two longitudinal ends, a pivotable lower structure supported by said rigid upper structure, a plurality of pairs of half ring members mounted to said pivotable lower structure, and an opening mechanism at one or each of said longitudinal ends of the upper structure, and a ridge or trough member on said upper structure between one or each of said longitudinal ends of the upper structure and a ring member nearest thereto, each of said ridge or trough members having a first and a second end, said first and second ends of said ridge or trough members being displaced from one another in a direction substantially transverse to the longitudinal axis of the upper structure.

6. A ring binder according to claim 5 wherein said first and second ends of each ridge or trough member are positioned symmetrical to each other across said longitudinal axis of the upper structure.

7. A ring binder according to claim 5 wherein said first and second ends of each ridge or trough member point generally towards the longitudinal end of the upper structure nearest thereto.

8. A ring binder according to claim 5 wherein each of said ridge or trough members comprise a middle peak turning portion located substantially on the longitudinal axis of the upper structure.

9. A ring binder according to claim 5 wherein each of said ridge or trough members comprise two outer turning portions positioned symmetrical to each other across said longitudinal axis of the upper structure.

10. A ring binder according to claim 8 wherein said middle peak turning portion has a turning angle of 50 to 70 degrees.

11. A ring binder according to claim 9 wherein said two outer turning portions have turning angles of 50 to 70 degrees.

12. A ring binder according to claim 5 wherein each ridge or trough member is substantially symmetrical about the longitudinal axis of the upper structure.

13. A ring binder according to claim 5 wherein the ridge or trough member is substantially "W" shaped.

14. A ring binder comprising substantially rigid upper structure having a longitudinal axis defined by two longitudinal ends, a pivotable lower structure supported by said rigid upper structure, a plurality of pairs of half ring members mounted to said pivotable lower structure, and an opening mechanism at one or each of said longitudinal ends of the upper structure, and a ridge or trough member on said upper structure between one or each of said longitudinal ends of the upper structure and a ring member nearest thereto, each of said ridge or trough members having a first and a second end, said first and said second ends of each ridge or trough member are positioned symmetrical to each other across said longitudinal axis of the upper structure and point generally towards the longitudinal end of the upper structure nearest thereto, each of said ridge or trough members having a middle peak turning portion located substantially on the longitudinal axis of the upper structure and two outer turning portions positioned symmetrical to each other across said longitudinal axis of the upper structure, each of said outer and middle turning portions having turning angles of 50 to 70 degrees.

* * * * *